United States Patent [19]

Howard et al.

[11] Patent Number: 4,780,977

[45] Date of Patent: Nov. 1, 1988

[54] PAGE TURNING APPARATUS

[75] Inventors: James M. Howard, Dover; Constantine Tsoucalas, Bergenfield, both of N.J.

[73] Assignee: Maddak, Inc., Pequannock, N.J.

[21] Appl. No.: 93,720

[22] Filed: Sep. 8, 1987

[51] Int. Cl.[4] ..... G09F 19/00

[52] U.S. Cl. ..... 40/531; 84/487

[58] Field of Search ..... 40/531, 487; 84/502, 84/487, 517

[56] References Cited

U.S. PATENT DOCUMENTS

| | | | |
|---|---|---|---|
| 3,064,518 | 11/1962 | Chernishenko | 84/487 |
| 3,277,596 | 10/1966 | Shachar | 40/531 |
| 3,281,974 | 11/1966 | Jensen | 40/531 |
| 3,371,571 | 3/1968 | Barbera | 84/502 |
| 3,475,844 | 11/1969 | Uda et al. | 84/517 |
| 3,484,970 | 12/1969 | Berlinsky et al. | 40/531 |
| 3,570,154 | 3/1971 | Cosenza | 40/531 |
| 3,800,453 | 4/1974 | Kroes | 84/486 X |
| 4,488,367 | 12/1984 | Yamauchi | 40/531 |
| 4,644,675 | 2/1987 | Berger et al. | 84/487 |

*Primary Examiner*—Gene Mancene
*Assistant Examiner*—Wenceslao J. Contreras
*Attorney, Agent, or Firm*—Anthony F. Cuoco

[57] ABSTRACT

Apparatus is disclosed which is operable for turning a page of a book, or other like reading material, and for retaining said page in a turned position. The page is turned via a vacuum arrangement which draws a single page away from the rest of the pages and an arm which is disposed in back of the single page and is displaced to turn said page from right to left. The page is retained in the turned position by means synchronously operataed with the page turning arrangement and including an arm which rests on the turned page to prevent said page from returning to the unturned page position.

13 Claims, 4 Drawing Sheets

PAGE TURNING APPARATUS

BACKGROUND OF THE INVENTION

Handicapped persons, invalids and others who permanently or temporarily lack the manual dexterity for turning the pages of books, magazines and like reading material are frequently denied the enjoyment of reading same, or must have the assistance of others to accomplish this purpose. This renders such persons dependent upon others and otherwise impedes their ability to be self-sufficient which is an important factor in their well being. The present invention recognizes the desire of persons of the type described to be as self-sufficient as possible and therefore provides apparatus which enables such persons to accomplish turning the pages of reading material from right to left as is normally the case.

SUMMARY OF THE INVENTION

This invention contemplates apparatus for turning the pages of reading material such as a book and the like, including page turning means and page retaining means, both of which may be clamped to a support for the book.

The page turning means generates a vacuum which draws a single page away from the rest of the pages of the book. As the single page is drawn away, a motor driven arm is disposed in back of the single page and is effective for turning said page from right to left. A plurality of switches are arranged to be sequentially effective for rendering the page turning means operable from a "start" position to complete the turning of a single page of the book and then to return to the "start" position in readiness for turning another single page.

The page retaining means includes an arm which is synchronously operated with the page turning means for resting on the turned page to retain said page in the turned position. The page retaining means is arranged as a plug-in module so that the page turning apparatus may be used with or without the page retaining means, as the case may be. The apparatus is actuated by a pneumatic switch which is designed for use particularly by those having need for said apparatus.

DETAILED DESCRIPTION OF THE INVENTION

Figure 1:
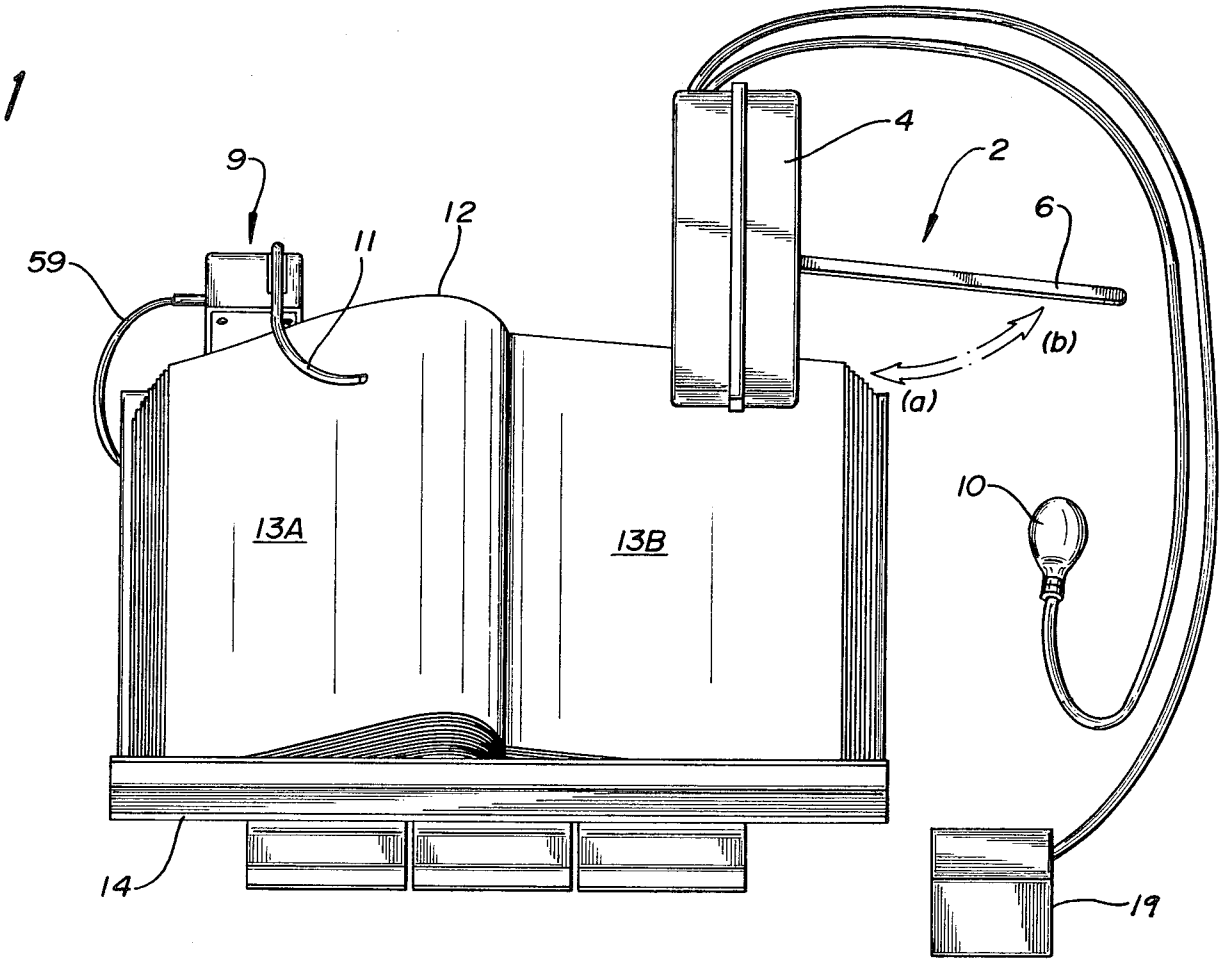
FIG. 1 is a pictorial representation generally showing the components of the invention.
Figure 4:
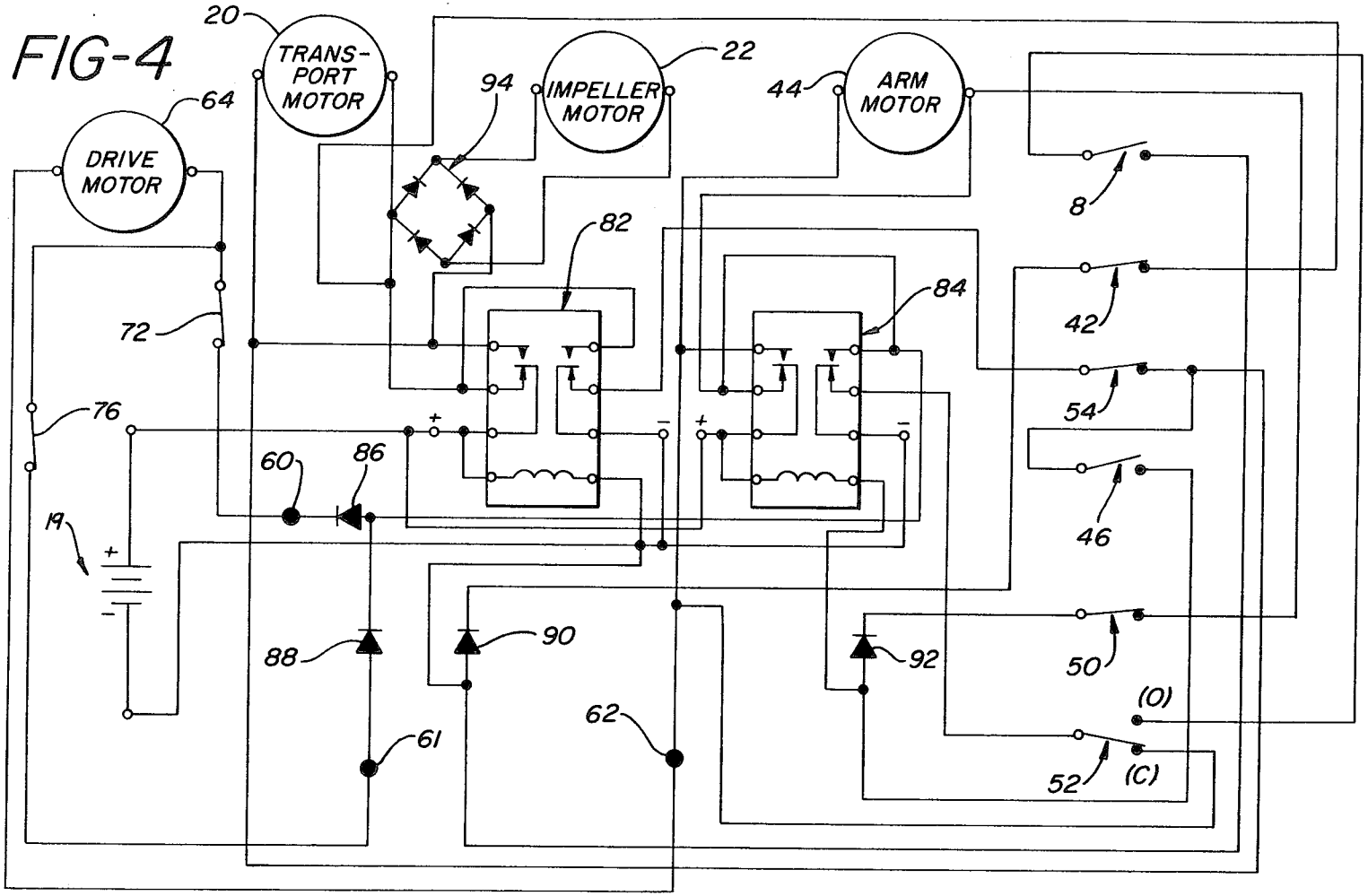
FIG. 4 is an electrical schematic diagram illustrating the electrical interconnections of the components of the invention.

With reference to FIG. 1, the disclosed apparatus includes page turning means designated generally by the numeral 2, and having a housing 4 and an arm 6 operated by a mechanism disposed within housing 4 as will be hereinafter described. Power is supplied via a constant polarity power supply shown as a battery 19 (FIGS. 1 and 4). Page turning means 2 is operated by squeezing a squeeze bulb or the like 10 which momentarily closes a switch 8, whereupon a relay 82 (FIG. 4) latches so as to energize a transport motor 20 and an impeller motor 22 (FIGS. 2 and 4).

A book or magazine or the like 12 is disposed on a rigid support 14. Although support 14 is shown as being a type of easel so as to hold book 12 in an inclined position, it need not necessarily be so for the purposes of the invention. Thus, book 12 may be held in a vertical position or in a horizontal position as the case may be. In any event, book 12 has its cover opened to left and right pages 13A, 13B being read by a reader, and lies flat on support 14 as shown in FIG. 1.

Figure 2:
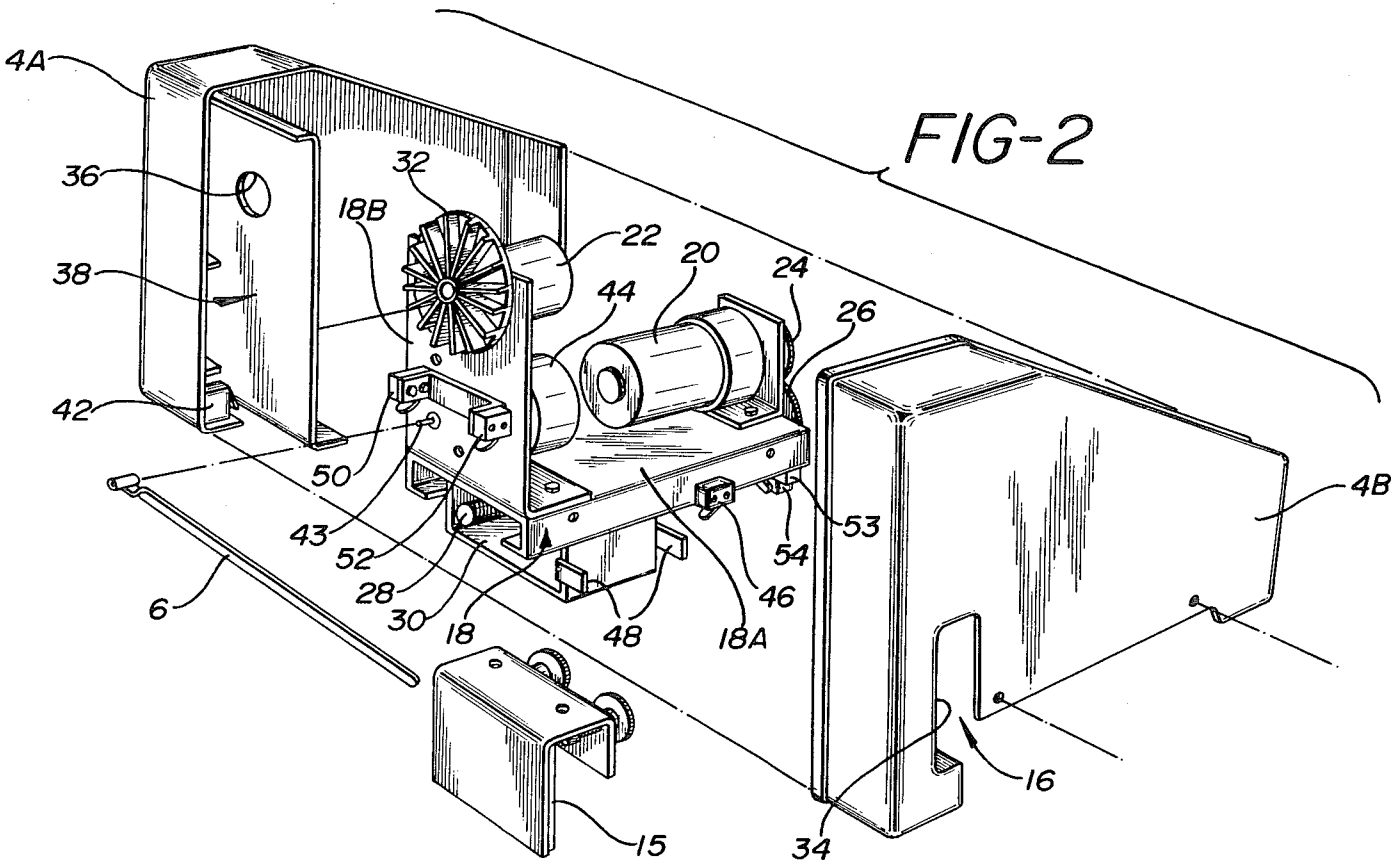
FIG. 2 is an exploded pictorial representation illustrating in substantial detail the page turning means of the invention.

Housing 4, which is clamped to support 14 by a clamp or the like 15 shown in FIG. 2, is disposed substantially parallel to the edge of right page 13B of open book 12 and has an opening 16 shown in FIG. 2 approximately one inch below the top of said page and between one-half and one and seven-eighths of an inch away from the edge thereof. Arm 6 is disposed above page 13B. This is considered as a "start" position for page turning means 2, and wherefrom the page turning means is activated for use as will be hereinafter described.

With reference to FIG. 2, housing 4 includes a pair of mating halves 4A and 4B. A chassis 18 is disposed within said housing halves, being suitably mounted therein by conventional means (not otherwise shown). Transport motor 20 is supported by a horizontal chassis member 18A and impeller motor 22 is supported by a vertical chassis 18B.

Upon momentarily closing normally open pneumatic switch 8 (FIG. 4) as aforenoted, transport motor 20 is energized as will be discerned from FIG. 4 and displaces page turner 2 from the "start" position towards book 12. This displacement occurs via gears 24 and 26 which are in meshing engagement. Gear 24 is affixed to a shaft (not otherwise shown) of transport motor 20 and gear 26 is affixed to a transport screw 28. The arrangement is such that transport motor 20 rotates gear 24 clockwise. This clockwise rotation rotates gear 26 counter-clockwise, with transport screw 28 rotating counter-clockwise with gear 26.

Transport screw 28 is mounted within chassis 18 to a screw bearing 53 secured to the chassis so as to ride along a stationary rider block 30 mounted to clamp 15 as by conventional means (not otherwise shown). The counter-clockwise rotation of screw 28 displaces the screw toward book 12, whereby chassis 18 and all of the components supported thereby move toward the book.

Impeller motor 22 is energized upon closing switch 8 as will also be discerned from FIG. 4 and rotates an impeller 32 in a clockwise direction at a high speed, thereby generating a vacuum within housing 4. The vacuum starts at opening 16 of housing 4 and travels upward through a channel 34 and through a hole 36 in a vacuum plate 38.

Impeller 32 is disposed behind hole 36 and vacuum plate 38 is affixed to housing halves 4A and 4B when the housing halves are mounted each to the other by conventional means not otherwise shown. This creates a vacuum along the entire peripheral edge of vacuum plate 38 and the peripheral edge of the inner and upper walls of housing halves 4A and 4B. This, the vacuum is created by air passing through channel 34 starting from opening 16 and travelling through hole 36.

In accordance with the foregoing, upon closing normally open pneumatic switch 8 via squeeze bulb 10, page turning means 2 is displaced toward book 12 while a vacuum is being created. This displacement continues until opening 16 presses against page 13B. At this time the displacement of page turning means 2 is reversed. The page turning means travels away from the book and returns to the "start" position. Thereupon the vacuum acts to pull already read page 13B against opening 16 and to thereby effectively pull a single page (13B) away from the other right hand pages of book 12.

The reversed displacement of page turning means 2 is accomplished by reversing the rotational direction of transport motor 20 via a normally closed limit switch 42 shown in FIGS. 2 and 4. Switch 42 is mounted within housing half 4A directly inside opening 16 when housing halves 4A and 4B are fastened together as will be discerned from FIG. 2. When page turning means 2 travels a distance in accordance with the number of pages of book 12 left unturned so that opening 16 presses against page 13B as aforenoted, limit switch 42 is opened via pressing against book 12 so as to unlatch relay 82 (FIG. 4) to reverse the rotational direction of transport motor 20 as will be discerned from FIG. 4, whereby page turning means 2 moves away from the remaining pages on the right side of book 12. In this regard it is emphasized that the vacuum created as aforenoted is such so as to pull only one single page, i.e. page 13B away from the other pages.

Thus, single book page 13B is pulled away from book 12 until arm 6, suitably journaled to a shaft 43 of an arm motor 44 is displaced in the direction of arrow (a) shown in FIG. 1 from a substantially three o'clock position as shown in FIG. 1 to a substantially eight o'clock position. During this displacement arm 6 sweeps behind single page 13B being pulled away from book 12 so as to turn the page from right to left.

The aforenoted is accomplished via a normally open switch 46 shown in FIGS. 2 and 4 which is disposed on the side of chassis 18. As the displacement of the chassis is reversed via switch 42 as aforenoted, switch 46 sequentially travels over one of the flags 48 supported by rider block 30. Flag 48 triggers switch 46 so that the switch closes, whereupon relay 84 (FIG. 4) latches so that arm motor 44 is energized. In regard to flags 48, the flags are spaced so that one of the flags will be operative commensurate with the thickness of the right side of book 12, as will now be understood.

At approximately the eight o'clock position of arm 6, the rotational direction of arm motor 44 is reversed so that the arm is displaced in the direction of arrow (b) shown in FIG. 1. Arm 6 contacts a normally closed switch 50 shown in FIGS. 2 and 4 to open the switch, whereupon relay 84 is unlatched to reverse the direction of rotation of arm motor 44 and the arm is thereupon displaced back to the three o'clock "start" position. When arm 6 is at the three o'clock position the arm contacts a normally closed (c) switch 52 (FIGS. 2 and 4) to open (o) the switch which turns off arm motor 44. Thus, a single book page 13B has been displaced from right to left in accordance with the purpose of the invention.

During the displacement cycle of arm 6, page turning means 2 continues to move away from book 12 until screw bearing 53 mounted on the back end of chassis 18 as aforenoted presses against stationary rider block 30. Screw bearing 53 has mounted to its surface a normally closed switch 54 (FIGS. 2 and 4). Switch 54 is in an initial "start" position and presses against rider block 30. Movement of page turning means 2 towards book 12 displaces switch 54 away from rider block 30, whereupon the switch opens permitting transport motor 20 to displace page turning means 2 to the "start" position after switch 42 presses against book 12 as aforenoted. That is to say, when the direction of rotation of transport screw 28 is reversed, chassis 18 and screw bearing 53 are displaced back toward the initial "start" position. This position is achieved when page turning means 2 moves away from book 12 until screw bearing 53 presses against rider block 30. This effectively turns off transport motor 20. As will be discerned from FIG. 4, the opening of switch 54 as aforenoted is effective for turning off impeller motor 22. Upon the arm, transport and impeller motors 44, 20 and 22, respectively, being turned off, page turning means 2 assumes its original "start" position and is now positioned to turn another single page such as page 13B of book 12.

Figure 3:
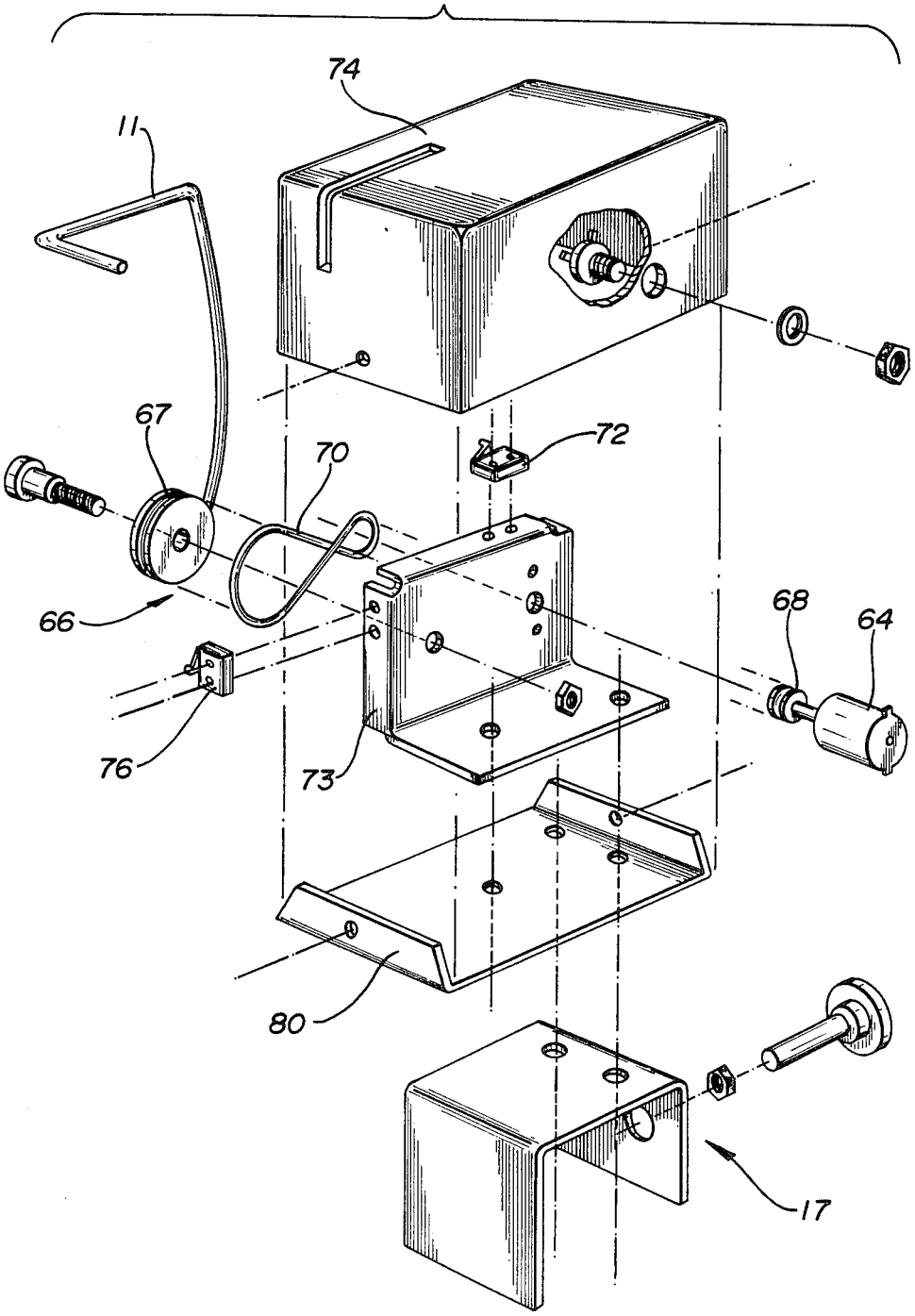
FIG. 3 is an exploded pictorial representation illustrating in substantial detail the page retaining means of the invention.

A page retaining means 9 is shown generally in FIG. 1 and is shown in substantial detail in FIG. 3. It will be noted that page retaining means 9 is disposed on the left side of book 12 and on the top edge of book support 14, being secured thereon by a clamp or the like 17 (FIG. 3) similar to clamp 15 heretofore referenced.

Page retaining means 9 includes a retaining arm 11 which is positioned in front of the book approximately seven inches to the left of page turning means 2. Arm 11 serves to retain a page, such as page 13A, which has been turned by page turning means 2 from right to left, and to prevent said page from accidentally or otherwise being returned to the right of book 12. Page retaining means 9 is an important accessory to the invention so far described in that it permits the user uninterrupted access to pages (13A, 13B) being read without page 13B being covered by a previous page that has been turned by the page turning means as might otherwise be the case.

Page retaining means 9 is connected to page turning means 2 via a plug-in electrical cable 59 at circuit points 60, 61 and 62 shown in FIG. 4. A drive motor 64 is activated by an electrical signal from page turning means 2 via normally open switch 46 when the switch is closed as aforenoted and as will be discerned with reference to FIG. 4. Motor 64 turns clockwise and drives retainer arm 11 via a belt and pulley arrangement 66. Belt and pulley arrangement 66 includes a pulley 67 coupled to retainer arm 11 and a pulley 68 coupled to the shaft of motor 64. A belt 70 couples pulleys 67 and 68.

Pulley 67 rotates counter-clockwise causing arm 11 to move away from book 12. The arm abuts a normally closed switch 72 shown in FIGS. 3 and 4, interrupting the signal from page turning means 2 and de-energizing motor 64. Arm 11 is brought to rest upon abutting a housing 74 and remains in a stationary upright position removed from the path of motion of the page being turned.

Motor 64 is re-energized when page turning means arm 6 (FIG. 1) contacts switch 50 (FIGS. 1 and 3) as aforenoted and as will be discerned from FIG. 4. Thereupon the signal to the page retaining means is reversed in polarity causing motor 64 to rotate counter-clockwise and powering belt and pulley arrangement 66. The counter-clockwise rotation of motor 64 imparts a clockwise rotation to pulley 67 causing page retainer arm 11 to sweep down and strike page 13A which has been turned from right to left, effectively completing the turning of the page. Retainer arm 11, upon pressing against a switch 76, de-energizes drive motor 64. Friction in belt and pulley arrangement 66 holds arm 11 in place until a signal is generated by page turning means 2 as aforenoted to re-energize motor 64.

In summary, page retaining means 9 is signaled by page turning means 2 to move retainer arm 11 away from book 12 and toward the book at appropriate times in accordance with the turning of a book page such as 13B from right to left. The disclosed apparatus includes switches to de-energize retainer arm motor 64 when the retainer arm has completed its displacement cycle. This de-energization prevents excessive wear on belt 70 and likewise prevents extreme current drain on motor 64.

It will be understood that the shape of arm 11, the friction in belt and pulley arrangement 66 and the speed of motor 64 are factors to be considered in the dynamic stability of page retaining means 9. Further, switches 72 and 76 are positioned so that no returning force is applied to retaining arm 11. For this reason and for ease of mounting, the switches are mounted parallel to the plane of displacement of arm 11 as will be discerned from FIG. 3.

All moving parts of page retaining means 9 are mounted to a bracket 73 by conventional means not otherwise shown. Bracket 73 and housing 74 are mounted to a mounting plate 80 via conventional means not otherwise shown. Housing 74 guides retainer arm 11 and prevents it from going past switches 72 and 76 structurally shown in FIG. 3 and schematically shown in FIG. 4. Cable 59 plugs into a suitable jack in housing 74 and into a similar jack in page turning means 2 to complete the modular connection between the retaining means and the page turning means.

With specific reference now to FIG. 4, the preferred embodiment of the electrical interconnection of the components is shown. Thus, the electrical interconnection between the several switches 8, 42, 46, 50, 52 and 54; battery 19; and the several motors 20, 22 and 44 of page turning means 2, via relay means designated generally by the numerals 82 and 84 and steering diodes 90 and 92, is illustrated. Likewise, the electrical interconnection between drive motor 44 of page turning means 2 and drive motor 64 of page retaining means 9, via switches 72 and 76, relay 84 and diodes 86 and 88 is illustrated.

A diode bridge rectifier 94 serves to maintain a polarity across impeller motor 22 so as to prevent reversal of the rotational direction of the motor, as is an important feature of the invention to insure that a vacuum is generated.

It will be understood that the electrical interconnections as illustrated in FIG. 4 can be implemented via solid state means and printed circuit boards as may be desirable.

The components herein referred to are commercially available components. For example, switch 52 may be a leaf switch such as marketed by Marquardt Switches, Inc., Cazenovia, N.Y. Switches 42, 46, 50 and 54 may be conventional microswitches such as marketed by Aromat, Inc., Lakeview, N.J. Pneumatic switch 8 may be of the type marketed by Pres Air Troll, Inc., Mamaroneck, N.Y.

In connection with air switch 8, the switch is described as operate by a squeeze bulb 10. It will be understood, however, that other switch operating devices particularly designed for those who have need for the apparatus of the invention may be used. These devices include pillow type operating devices and plate type operating devices which are operable by the functional parts of the body of the user of the invention.

Although the invention has been described in terms of use by the handicapped or others who lack the manual dexterity for turning the pages of a book or the like, it will be recognized that the invention is useful for others as well. For example, musicians or lecturers who find a need to have both hands free while referring to a book will find that the invention satisifies this need.

With the above description of the invention in mind reference is made to the claims appended hereto for a definition of the scope of the invention.

What is claimed is:

1. For use with a member such as a book or the like disposed on a supporting surface and opened for reading, apparatus for turning a read page from one side of the member to the other side, comprising:

a clamp for clamping the apparatus to the supporting surface;

a stationary block mounted to the clamp;

a chassis;

means for supporting the chassis on the block so that said chassis is displaceable toward and away from the member;

an arm;

means mounted to the chassis for supporting the arm so that said arm is displaceable in a plane substantially normal to the plane of displacement of the chassis;

said apparatus being initially in a "start" position, whereby the chassis is spaced away from said member and the arm is in a substantially three o'clock orientation;

means connected to the apparatus and to a power source for operating said apparatus;

means mounted to the chassis and connected to the operating means and operable thereby for generating a vacuum;

means mounted to the chassis and connected to the operating means and operable thereby for displacing the chassis toward the member, whereupon the generated vacuum pulls the read page away from the member when the chassis has been displaced a predetermined distance, and means for thereupon reversing the direction of displacement of the chassis so that said chassis is displaced away from said member;

means mounted to the arm and connected to the operating means and operable for displacing the arm from the substantially three o'clock orientation to a substantially eight o'clock orientation, whereupon the arm sweeps behind the pulled away page to turn said page as the chassis is displaced away from the member; and means for reversing the direction of displacement of the chassis when the chassis has been displaced a predetermined distance away from the member, and means for reversing the direction of displacement of the arm, so that said apparatus returns to the "start" position, and is ready to turn another page from one side of the member to the other side.

2. Apparatus as described by claim 1, including:

means connected to the power source and to the means for generating a vacuum and operative for rendering the vacuum generating means inoperable when said apparatus returns to the "start" position.

3. Apparatus as described by claim 1, including:

means connected to the power source and to the means for displacing the chassis and operative for rendering the chassis displacement means inoperable when said apparatus returns to the "start" position.

4. Apparatus as described by claim 1, including:

means connected to the power source and to the means for displacing the arm for rendering said arm displacement means inoperable when said apparatus returns to the "start" position.

5. Apparatus as described by claim 2, including:

means connected to the power source and to the means for displacing the chassis and operative for rendering the chassis displacement means inoperable when said apparatus returns to the "start" position.

6. Apparatus as described by claim 3, including:

means connected to the power source and to the means for displacing the arm for rendering said arm displacement means inoperable when said apparatus returns to the "start" position.

7. Apparatus as described by claim 1, including means for retaining the turned read page on the other side of the member, said page retaining means including:

a clamp for clamping the page retaining means to the supporting surface;

a mounting plate mounted to the clamp;

a bracket mounted to the mounting plate;

a housing disposed over the bracket and mounted to the mounting plate;

a retaining arm;

means mounted to the bracket for supporting the retaining arm so that said arm is displaceable away from and toward the turned page; and means connected to the retaining arm supporting means and to the means for displacing the arm from the substantially three o'clock orientation to the substantially eight o'clock orientation, and responsive to a signal from said arm displacing means for displacing the retaining arm so that said retaining arm is removed from the path of motion of the page while the page is being turned and strikes the page to retain the page on the other side of the member when said page has been turned.

8. Apparatus as described by claim 7, including:

means connected to the arm displacing means and to the retaining arm displacing means for interrupting the signal from the arm displacing means, whereupon the retaining arm is brought to rest upon abutting the housing and remains at rest removed from the path of motion of the page being turned.

9. Apparatus as described by claim 7, wherein:

the means mounted to the bracket for supporting the retaining arm includes belt and pulley means; and friction in the belt and pulley means is effective for holding the retaining arm in place when the retaining arm strikes the page to retain the page on the other side of the member when said page has been turned.

10. Apparatus as described by claim 8, including:

the means mounted to the bracket for supporting the retaining arm includes belt and pulley means; and friction in the belt and pulley means is effective for holding the retaining arm in place when the retaining arm strikes the page to retain the page on the other side of the member when said page has been turned.

11. Apparatus as described by claim 1, wherein:

the means for generating a vacuum includes a motor having an impeller mounted thereto and operable for rotating in a direction to generate said vacuum.

12. Apparatus as described by claim 11, including:

means connected to the motor for insuring that the motor rotates in said direction to generate the vacuum.

13. Apparatus as described by claim 1, wherein:

the means connected to the apparatus and to the power source for operating said apparatus includes a pneumatic switch.

* * * * *